United States Patent [19]

Beasley et al.

[11] 4,217,837

[45] Aug. 19, 1980

[54] FINE GAUGE LOOPER APPARATUS FOR IN-LINE TUFTING MACHINE

[75] Inventors: Max M. Beasley, Chattanooga, Tenn.; Leroy A. Defore; Hugh C. King, both of Dalton, Ga.

[73] Assignee: Tuftco Corporation, Chattanooga, Tenn.

[21] Appl. No.: 34,340

[22] Filed: Apr. 30, 1979

[51] Int. Cl.[2] ..... D05C 15/00

[52] U.S. Cl. ..... 112/79 R

[58] Field of Search ..... 112/79 R, 79 A

[56] References Cited

U.S. PATENT DOCUMENTS

| | | | |
|---|---|---|---|
| 2,800,096 | 7/1957 | Signoret | 112/79 R |
| 2,889,791 | 6/1959 | Fedevich | 112/79 R |
| 3,880,101 | 4/1975 | Passon | 112/79 R |
| 4,158,339 | 6/1979 | Short | 112/79 R |

*Primary Examiner*—Ronald Feldbaum
*Attorney, Agent, or Firm*—Harrington A. Lackey

[57] ABSTRACT

A fine gauge looper apparatus for an in-line tufting machine, and preferably for a cut pile tufting machine, comprising a transverse hook bar having slot means in the front thereof, including a plurality of slots on the same needle gauge, opening through the front face of the hook bar to receive the body portions of the corresponding looper hooks, and a plurality of clamp members movably mounted on the front face of the hook bar for releasably clamping the front surfaces of the hooks in order to stably support thin looper hooks in a fine gauge tufting machine of the order of 1/16th of an inch, and for ready movement to an unclamping position for releasing, removing, inserting and replacing individual hooks.

9 Claims, 6 Drawing Figures

FINE GAUGE LOOPER APPARATUS FOR IN-LINE TUFTING MACHINE

BACKGROUND OF THE INVENTION

This invention relates to a multiple-needle tufting machine, and more particularly to a looper apparatus for a fine gauge, in-line tufting machine.

The conventional hook bars for multiple-needle tufting machines are long bars extending transversely of the machine below the needles and the base fabric. A conventional cut-pile hook bar has uniformly spaced slots in its front face for receiving the hooks which cooperate with the needles to form loops in the yarns carried by the needles. For a narrow gauge, multiple-needle tufting machine, the slots in the front face of the hook bar must be formed close together. The closeness of the spacing of the looper slots is limited by the thinness of the walls between the slots. Conventional loopers or hooks are held in their respective slots by individual set screws which are threaded into each slot and engage the opposed walls of the slots. Thus, the thinness of the walls is further limited by the diameters of the set screws.

One solution to spacing the looper slots closer together for narrow gauge tufting machines is disclosed in the prior U.S. Pat. No. 3,635,177, issued to Larry P. Gable, et al. for NARROW GAUGE HOOK BAR FOR TUFTING MACHINE on Jan. 18, 1972. The Gable patent discloses a hook bar having uniformly spaced, but staggered, looper slots formed alternately in the front and rear faces of the hook bar. Thus, the staggered front and rear slots receive two transverse rows of staggered hooks or loopers for cooperation with corresponding staggered needles. However, the hook bar disclosed in the Gable patent was primarily designed for a looper apparatus for forming narrow gauge loop pile.

Another solution to spacing the slots close together for narrow gauge tufting machine is disclosed in the U.S. Pat. No. 4,067,270 of Hoyt E. Short for "NARROW GAUGE CUT PILE TUFTING APPARATUS" in which the needles are staggered and the loopers are made quite thin and flexible for bending and veering around each of the corresponding staggered needles.

A further solution to the spacing of the loopers and slots in narrow gauge machines is disclosed in the U.S. Pat. No. 4,158,339 of Hoyt E. Short, issued June 19, 1979, for "NARROW GAUGE CUT PILE LOOPER APPARATUS." In this narrow gauge cut-pile tufting machine, the needles are staggered and the slots are formed in the front and rear faces of the hook bar. However, the slots are designed to extend along the top of the hook bar and to receive and reinforce the elongated body portions of the specifically constructed looper hooks.

SUMMARY OF THE INVENTION

It is therefore an object of this invention to provide in a fine gauge, in-line tufting machine, an improved looper apparatus having uniformly spaced narrow slots for receiving thin looper hooks, provided with external clamping members for supporting the hooks in their respective slots in a stable position. The looper apparatus made in accordance with this invention is especially designed for in-line tufting machines, that is tufting machines having a single transverse row of needles, having a fine needle gauge in the order of 1/16th of an inch.

Because the looper hooks must be made of relatively thin material, for such fine gauges, yet must have bills of sufficient length projecting from the body portion of the looper hooks to cross and cooperate with the corresponding needles, the hooks must be substantially rigidly supported.

Moreover, because of the extremely narrow gauge of the needles and the hooks, the hooks can no longer be fixed in their respective slots by the conventional set screws, but must be provided with external, releasable holding or clamping members.

In the preferred form of the invention, a transverse hook bar is provided with an elongated transverse groove opening forward and adapted to receive a slotted insert member, which has a rearward projecting tongue member for reception in the groove. The main or forward portion of the insert member is provided with vertical forward and upward opening slots on the same needle gauge as the tufting machine for receiving each of the corresponding looper hooks. Each of the hooks has a large main body portion and a rearward projecting tang which is adapted to be received in a tang receiving portion of the slot within the tongue member. Thus, not only is the tang completely received in a portion of the slot, but also both sides of the main body portion of the hook fits snugly between the opposing walls of the corresponding slot. A plurality of external clamp members are secured by threaded bolts to the forward face of the hook bar so that each of the clamp members may be squeezed rearward against the forward surfaces of the main body portions of the hooks. The clamp members may be quickly released by unthreading the bolt members so that the clamp bars or clamp members may slide down to render the individual hooks accessible for substitution, removal or insertion into their corresponding slots.

By employing the insert members, insert members of different gauges could be interchanged. Furthermore, it is easier to build the hook slots in an insert member than it is to build the same slots in a solid transverse hook bar.

DESCRIPTION OF THE PREFERRED EMBODIMENTS

Figure 1:
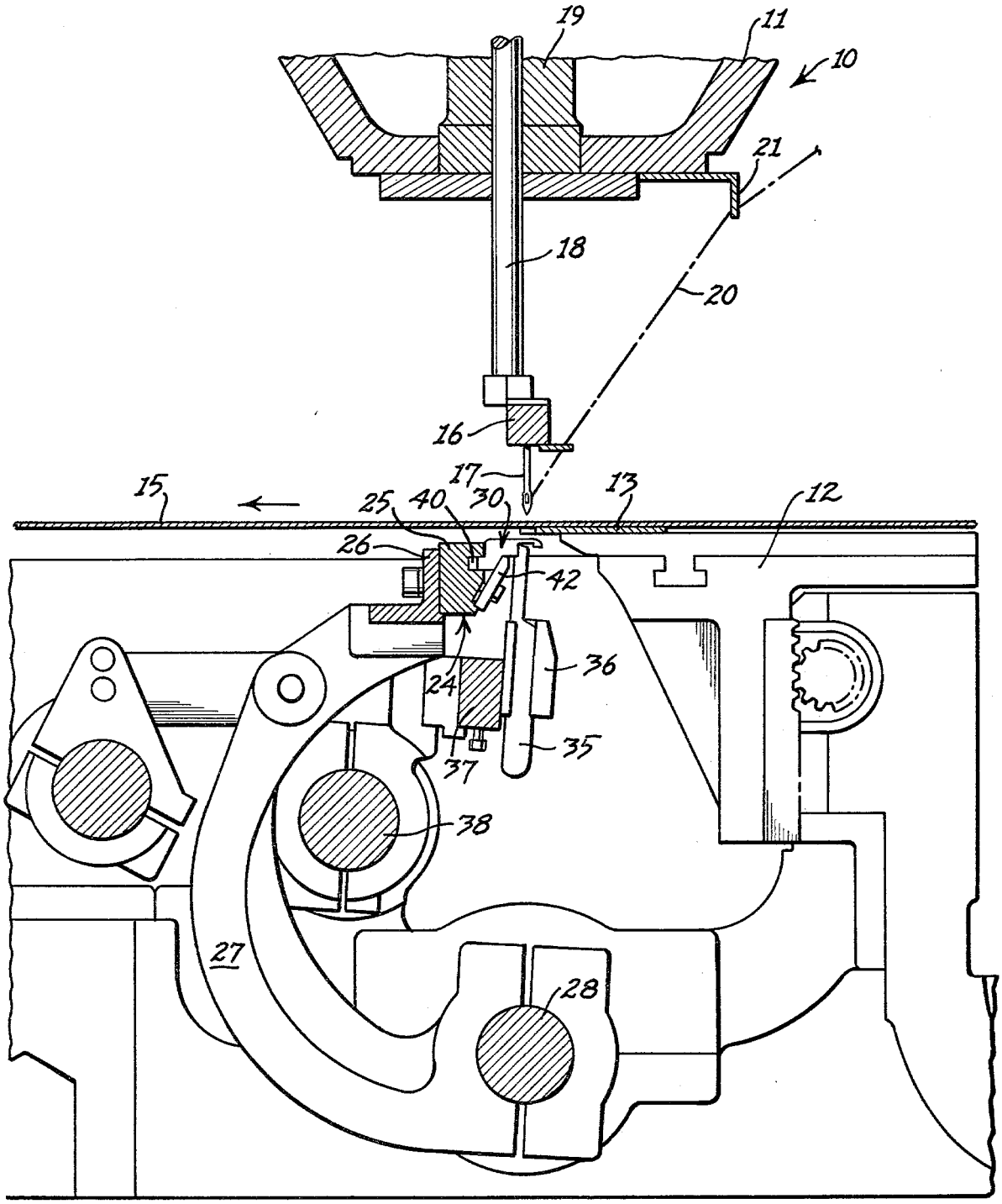
FIG. 1 is a fragmentary, sectional elevation taken longitudinally through a portion of a fine gauge, in-line tufting machine incorporating a looper apparatus made in accordance with this invention, and disclosing the needles and loopers in operative loop-forming position.

Referring now to the drawings in more detail, FIG. 1 discloses a fine gauge, in-line tufting machine 10 made in accordance with this invention, including a frame or housing 11 having a bed plate 12 upon which is supported a needle plate 13. The needle plate 13 is adapted to support in a substantially horizontal plane, a web or base fabric 15 adapted to be moved by conventional means, not shown, in the direction of the arrow from front to rear through the machine 10.

Extending transversely of the machine 10 above the needle plate 13 is a transverse needle bar 16 supporting a plurality of uniformly spaced and transversely aligned, or in-line, needles 17. The needle bar 16 is supported by a plurality of transversely spaced push rods 18, only one of which is shown in FIG. 1, adapted to vertically reciprocate within the sleeve or bearing 19 in the housing 11.

Yarn 20 is fed to each of the needles 17 by any convenient means, not shown, through the fixed yarn guide 21.

The looper apparatus 24 made in accordance with this invention includes a hook bar 25 fixed to support angle 26 at the upper end of a plurality of rocker arms 27, the lower ends of which are fixed to the reciprocably driven, transversely extending, hook shaft 28.

The looper apparatus 24 includes a plurality of looper hooks 30 of uniform size and shape, each including a main body portion 31, a throat portion 32, a bill 33, and a rearward projecting tang 34.

To produce cut pile, knives 35 are mounted in knife holders 36 upon the transversely extending knife bar 37, which is adapted to be rocked or reciprocated in timed relationship with the hook shaft 28 by means of the knife shaft 38. Each of the knives 35 is adapted to cooperate with each corresponding looper hook 30 in a conventional manner for forming cut pile tufts.

The looper apparatus 24 made in accordance with this invention comprises a hook bar member including the hook bar 25 and a transversely extending, L-shaped insert member 40, the looper hooks 30 and a plurality of clamp members 42.

The hook bars 25 are preferably made in sections or modules of limited length, such as approximately 6 inches long, and include an elongated, transverse, rectangular shaped groove 44 opening through the front face 45 of the hook bar 25.

The insert member 40 is L-shaped having a front upright leg portion 47 and a rearward projecting tongue member 48. The tongue member 48 is of substantially the same size and shape as the groove 44 so that the tongue member 48 is snugly received within the groove 44 to stably support insert member 40 within the hook bar 25.

A plurality of uniformly transversely spaced vertical slots 50 are formed in the upright leg portion 47 of the insert member 40. These slots 50 open through the top and bottom surfaces, as well as through the forward face of the insert member 40. The width of each slot 50 is just great enough to snugly receive the main body portion 31 of each of the looper hooks 30. The tang 34 of each hook 30 projects rearwardly into tang slot 51, a rearward continuation of the slot 50 for snugly receiving the tang 34. When a looper hook 30 is fitted within the slots 50 and 51 of the insert member 40, the hook 30 is stably supported, not only against lateral translatory movement, but also against lateral twisting and vertical pivotal movement, as well as vertical translatory movement.

The clamp members 42 securely lock the hooks 30 within the insert member 40, and, in turn, the insert member 40 within the hook bar 25. Each clamp member 42 is preferably of generally rectangular shape, elongated upward and adapted to seat against the angular front surfaces 53 of the hooks 30. Each clamp member 42 is held in position upon the lower angular front face 54 of the hook bar 25 by a threaded bolt member 55. The bolt member 55 extends through an upwardly directed, elongated, mounting slot 56 within the clamp member 42. The shank of the bolt 55 is threaded within a cooperating threaded opening or hole 57 within the hook bar 25.

The upper or top edge of each clamping member 42 is serrated or slotted to form the upward opening, uniformly transversely spaced kerfs 58. These kerfs have the same spacing as the needle gauge, and each kerf 58 is adapted to receive a bottom edge of the main body portion 31 of each hook 31 in order to further support and stabilize or reinforce the hooks 30 upon the hook bar 25.

The machine 10 is an in-line tufting machine having a needle gauge of 1/16th of an inch. For such a fine gauge, each slot 50 has been made with a width of 0.023 inches to accommodate a hook 30 of slightly lesser thickness. The needles 17 are of small diameter and occupy substantially the entire space between adjacent hooks 30. Each hook bar 25 has been made in sections or modules of lengths of 5.995 inches plus or minus 0.001 inch. The insert member 40 for each module includes 96 hook slots 50. The modules M1, M2, M3 are disclosed in FIG. 2 in end-to-end abutting relationship.

Figures 2, 3, 4, 5, 6:
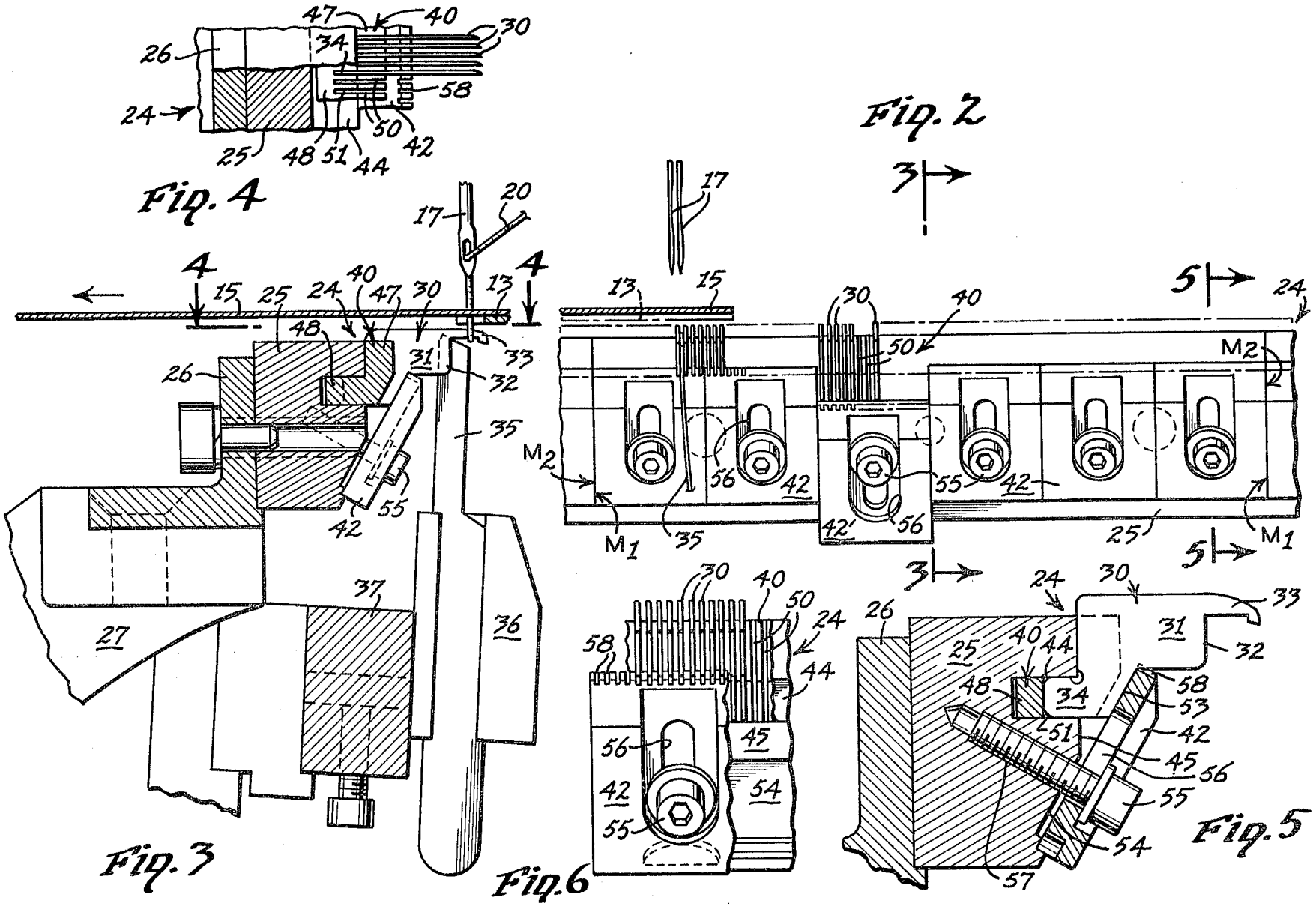
FIG. 2 is an enlarged, fragmentary, front elevation of the looper apparatus made in accordance with this invention, with one of the clamp members in an inoperative position.
FIG. 3 is a fragmentary section taken along the line 3—3 of FIG. 2; and including the cutting apparatus.
FIG. 4 is a fragmentary view taken along the line 4—4 of FIG. 3, with portions of the hook bar member broken away.
FIG. 5 is an enlarged, fragmentary section taken along the line 5—5 of FIG. 2.
FIG. 6 is a fragmentary front elevation of the looper apparatus disclosed in FIG. 5, with portions broken away.

Each module such as the module M2 is provided with 6 clamp members 42, 5 of which are disclosed in FIG. 2 in their upper operative clamping positions, while one of the clamping members 42′ is disclosed in its lowered inoperative position rendering 16 hook slots 50 and their corresponding hooks 30 accessible for insertion, removal or replacement. The clamp slots 56 are just long enough so that when the bolt 55 is at the lower end of the slot, the clamp member 42 is in its elevated clamping position, but when the bolt member 55 rests in the upper end of the clamp slot 56, the clamp member 42 is in its lowermost inoperative or releasing position, low enough that the hooks 30 may be moved forward and clear the clamp member 42 for easy removal. When the clamp member, such as clamp member 42′ is in its lowermost position, 16 looper hooks 30 may be inserted within their respective slots 50 by moving the hooks 30 rearward until the tangs 34 fit within and abut against the rear ends of the respective tang slots 51. The body portion of each hook 31 is then snugly and stably supported and reinforced between the walls of the respective slots 50. The clamp member 42 or 42′ is then raised until the respective kerfs 58 engage the bottoms of the throat portions 32, and the bolt 55 is tightened to seat the clamp 42 against the forward sloping edge portion 53 of the respective hook 30, as disclosed in FIG. 3.

Thus, the hooks 30 are strongly reinforced not only by their containment within the respective tang slots 51 and upright slots 50, but also by the kerfs 58 and the seating of the clamp members 42 against the forward sloping portions 53. In this manner, all of the hooks 30 are rigidly supported in precise uniform spacing at the exact needle gauge for cooperation with the respective knives 35 and needles 17, to form cut pile.

What is claimed is:

1. In a tufting machine having means for supporting a base fabric for longitudinal movement in the feeding direction through said machine, a plurality of transversely spaced and transversely aligned reciprocal needles for introducing yarns through said base fabric to form loops, looper apparatus comprising:

(a) a plurality of looper hooks, each hook having a body portion including a rear portion and a front surface, and a tang projecting rearward from said body portion, (b) a hook bar member having a front face and mounted transversely below the plane of the base fabric for longitudinal reciprocal movement between an operative position below said needles and an inoperative position, (c) said hook bar member comprising slot means including a plurality of transversely spaced slots having the same gauge as the needles, each slot opening through said front face, (d) each slot comprising a body slot portion for receiving the body portion of each corresponding hook, and a tang slot portion opening rearward from each corresponding body slot portion for receiving said tang, and (e) at least one clamp member mounted on said hook bar member for releasably engaging the front surface of the body portions of said hooks received in said slot means to hold said hooks in said hook bar member.

2. The invention according to claim 1 in which each of said slots opens through the top of said hook bar member.

3. The invention according to claim 1 in which said slot means is an insert member including said spaced slots, said hook bar member further comprising a hook bar having an elongated transverse groove opening through said front face for receiving a portion of said insert member, said clamp member being mounted on the front face of said hook bar.

4. The invention according to claim 3 further comprising mounting means supporting said clamp member on said front face for movement between an upper operative clamping position opposite said groove for engaging the front surfaces of said hooks in said slots, and a lower inoperative position disengaging said hooks for removal of said hooks from said slots.

5. The invention according to claim 4 in which said mounting means comprises an elongated, upwardly extending mounting slot in said clamp member, and a threaded bolt member extending through said mounting slot and threadedly engaging said hook bar.

6. The invention according to claim 5 in which said clamp member has an upper edge, and a plurality of transversely spaced kerfs in said upper edge having the same gauge as said needles for receiving corresponding body portions of said hooks in said operative clamping positions.

7. The invention according to claim 5 in which each of the body portions of said hooks has uniformly inclined front surface portions, and the front face of said hook bar having an inclined portion below and in substantial alignment with said inclined front surface portions, each of said clamp members being mounted on said inclined portion and seated against said inclined front surface portions in operative positions.

8. The invention according to claim 3 in which said insert member has a front vertical leg portion including said body slot portions and a rearward projecting tongue member including said tang slot portions terminating in said tongue member, said transverse groove in said hook bar being adapted to receive said tongue member.

9. The invention according to claim 1 in which each of said looper hooks has a throat portion and a bill, a plurality of transversely aligned knives, each of said knives being adapted to cooperate with the throat portion of a corresponding looper hook to form cut pile, said knives being located in front of said clamp member, and means for reciprocably moving said knives in synchronism with the movements of said hooks and the needles.

* * * * *